US010906035B2

(12) United States Patent
Drechsler

(10) Patent No.: US 10,906,035 B2
(45) Date of Patent: Feb. 2, 2021

(54) MODIFIED SAMPLE PROCESSING DEVICE

(71) Applicant: Roche Molecular Systems, Inc., Pleasanton, CA (US)

(72) Inventor: Thomas Drechsler, Hopkinton, MA (US)

(73) Assignee: Roche Molecular Systems, Inc., Pleasanton, CA (US)

( * ) Notice: Subject to any disclaimer, the term of this patent is extended or adjusted under 35 U.S.C. 154(b) by 313 days.

(21) Appl. No.: 15/989,713

(22) Filed: May 25, 2018

(65) Prior Publication Data

US 2018/0345274 A1 Dec. 6, 2018

Related U.S. Application Data

(60) Provisional application No. 62/512,516, filed on May 30, 2017.

(51) Int. Cl.
*B01L 3/00* (2006.01)
*B01L 7/00* (2006.01)

(52) U.S. Cl.
CPC ..... *B01L 3/502* (2013.01); *B01L 7/525* (2013.01); *B01L 2200/026* (2013.01); *B01L 2200/0668* (2013.01); *B01L 2200/0689* (2013.01); *B01L 2200/10* (2013.01); *B01L 2200/16* (2013.01); *B01L 2300/044* (2013.01); *B01L 2300/087* (2013.01); *B01L 2300/0832* (2013.01); *B01L 2300/123* (2013.01); *B01L 2400/0481* (2013.01); *B01L 2400/06* (2013.01); *B01L 2400/0655* (2013.01)

(58) Field of Classification Search
None
See application file for complete search history.

(56) References Cited

U.S. PATENT DOCUMENTS

| | | | | |
|---|---|---|---|---|
| 2,550,797 | A | 5/1951 | Friedmann | |
| 2002/0064484 | A1* | 5/2002 | Lin | B01L 3/50215 422/561 |
| 2004/0161788 | A1* | 8/2004 | Chen | G01N 33/543 435/6.11 |
| 2007/0292858 | A1* | 12/2007 | Chen | B01L 3/502 435/6.18 |

(Continued)

FOREIGN PATENT DOCUMENTS

| | | | |
|---|---|---|---|
| EP | 1106250 | A2 | 6/2001 |
| WO | 2007100500 | A2 | 9/2007 |

OTHER PUBLICATIONS

International Search Report and Written Opinion dated Jun. 27, 2018 in corresponding PCT/EP2018/064166 filed on May 30, 2018, pp. 1-11.

*Primary Examiner* — Jill A Warden
*Assistant Examiner* — Brittany I Fisher
(74) *Attorney, Agent, or Firm* — Charles M. Doyle; Pamela C. Ancona

(57) ABSTRACT

A sample processing tubule is provided including, from a proximate to a distal end, an opening through which a sample is introducible, at least three segments, and an extraction port operatively connected to a distal segment of the at least three segments. The extraction port enables extraction of a reaction mixture in the distal segment of the tubule without piercing the tubule or one or more seals separating each of the segments in the tubule.

10 Claims, 3 Drawing Sheets

(56) References Cited

U.S. PATENT DOCUMENTS

| | | | | |
|---|---|---|---|---|
| 2008/0003564 | A1* | 1/2008 | Chen | B01L 3/502 435/5 |
| 2009/0011417 | A1 | 1/2009 | Maltezos et al. | |
| 2009/0215125 | A1* | 8/2009 | Reed | C12Q 1/6806 435/91.2 |
| 2012/0275955 | A1* | 11/2012 | Haghgooie | A61B 5/154 422/44 |
| 2014/0356941 | A1* | 12/2014 | Bransky | B01L 3/502738 435/306.1 |

* cited by examiner

MODIFIED SAMPLE PROCESSING DEVICE

CROSS-REFERENCE TO RELATED APPLICATIONS

The present application claims the benefit of priority under 35 U.S.C. § 119(a) of U.S. Provisional Application No. 62/512,516, filed May 30, 2017, the disclosure of which is incorporated herein by reference in its entirety. Reference is also made to the following U.S. patents and Published applications: U.S. Pat. Nos. 7,718,421; 6,748,332; 6,780,617; 7,799,521; 6,318,191; 7,337,072; 7,833,489; 8,148,116; 7,935,504; 6,964,862; 6,318,191; 6,748,332; 7,799,521; 8,936,933; 7,785,535; 8,414,845; 2015-0105300; 2013-0040830; and 2012-0276532, as well as U.S. Provisional Application Ser. No. 62/512,537 (filed on May 30, 2017). The disclosures of each of these applications and publications are incorporated herein by reference in their entireties.

FIELD OF DISCLOSURE

Sample preparation is frequently required in performing diagnostic assays, particularly in the processing of biological samples. A biological sample, for instance, typically undergoes intensive, demanding processing before it is in condition suitable for an assay. Proper sample preparation often requires precise conditions, such as particular temperatures, concentrations, reagent volumes, and, especially, the removal of materials that can interfere with the desired assay. Frequently a raw sample must be removed to a distant location to receive proper processing by highly skilled personnel in a tightly controlled laboratory setting. Conventional processing devices and methods often require large, highly complex and sophisticated instrumentation. These factors of conventional sample processing necessarily cause a delay in the time to result, high costs, compromised sample integrity and limitations on the practicality of using diagnostic assays in many instances.

SUMMARY

The present disclosure provides devices and methods for processing samples. The disclosed devices and methods can facilitate the preparation of samples through multiple processing steps.

In a specific embodiment, the disclosure contemplates a sample processing tubule comprising, from a proximate to a distal end, an opening through which a sample is introducible, at least three segments, and an extraction port fluidly connected to a distal segment of the at least three segments. The extraction port can be a septum, a frangible seal, a luer taper connection, or a mechanical valve. The tubule can also include a frame to which the tubule is mounted, and in one particular embodiment, the extraction port is fixedly mounted to a base of the frame and the extraction port is accessed through an opening in the base.

Also provided is a method of harvesting a reaction mixture from the distal segment of the sample processing tubule described herein, and the method comprises piercing the septum with a needle or pipette tip and removing a portion of the reaction mixture through the port without piercing a seal between the distal segment and an adjacent segment of the tubule. Optionally, a vacuum is applied to facilitate the extracting step.

Moreover, the disclosure provides a method of processing a sample in a tubule, comprising: introducing a fluid through said opening, driving fluid flow from a first segment at the proximate end of said tubule to said distal segment, thereby contacting said sample with one or more reagents positioned in said tubule and/or reaction conditions to transform at least a portion of said sample into a reaction mixture, and removing an aliquot of said reaction mixture from said extraction port without piercing a seal between the distal segment and an adjacent segment of the tubule.

DETAILED DESCRIPTION

Unless otherwise defined herein, scientific and technical terms used in connection with the present disclosure shall have the meanings that are commonly understood by those of ordinary skill in the art. Further, unless otherwise required by context, singular terms shall include pluralities and plural terms shall include the singular. The articles "a" and "an" are used herein to refer to one or to more than one (i.e., to at least one) of the grammatical object of the article. By way of example, "an element" means one element or more than one element.

The term "sample" or "biological sample" refers to any composition containing or presumed to contain nucleic acid from an individual. The term includes purified or separated components of cells, tissues, or blood, e.g., DNA, RNA, proteins, cell-free portions, or cell lysates. A sample can also refer to other types of biological samples, e.g., plasma, serum, blood components (buffy coat), formalin-fixed paraffin-embedded tissue, and dried blood spots. Samples also may include constituents and components of in vitro cultures of cells obtained from an individual, including cell lines.

The present disclosure describes devices and methods for processing samples. In several embodiments, segmented tubules provide a convenient vessel for receiving, storing, processing, and/or analyzing a biological sample. In certain embodiments, the segmented tubule facilitates sample processing protocols involving multiple processing steps. In certain embodiments, a sample may be collected in a sample tubule, and the tubule is then positioned in an analyzer; the analyzer may then manipulate the tubule and its contents to process the sample. When the sample has been appropriately processed, a portion of the processed sample can be harvested from an extraction port positioned in the bottom of the tubule.

Figure 1B:
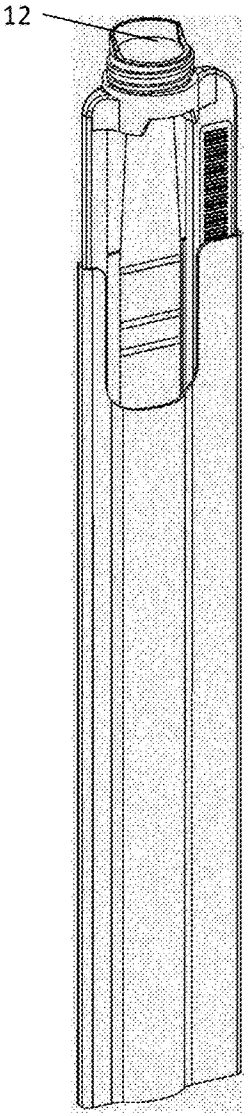
FIG. 1B is a perspective view of an exemplary embodiment of a sample tubule.
Figure 1A:
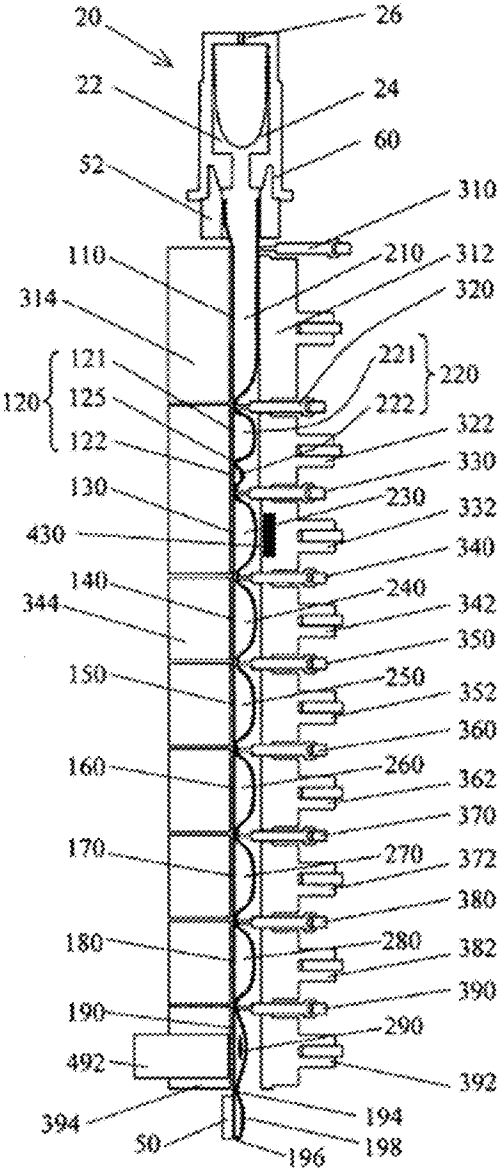
FIG. 1A is a cross sectional view of a sample tube positioned inside an analyzer.

One embodiment of the sample processing tubule is shown in FIGS. 1A-1B. The tubule includes a linear arrangement of 2 or more tubule segments 110, 120, 130, 140, 150, 160, 170, 180, and/or 190. A linear arrangement facilitates moving the sample and resultant waste and target through the tube in a controlled manner. A biological sample can be input through a first opening 12 in a first segment 110 of the tubule. Thereafter, waste from a processed sample can be moved back toward the first opening while the target is pushed towards the opposite end, thereby minimizing contamination of the target by reaction inhibitors that may have become attached to the tubule wall, and confining the target to a clean segment of the tubule which can contain suitable reagents for further operations of the target. Some embodiments may use a plurality of at least three segments, each containing at least one reagent. In some embodiments, these segments may contain reagents in the following order: the reagent in the second segment may be either a lysis reagent, a dilution or wash buffer, or a substrate; the reagent in the third segment may be either a substrate, a lysis reagent, a washing buffer or a neutralization reagent; the reagent in the fourth segment may be a wash buffer, a suspension buffer, an elution reagent, or nucleic acid amplification and detection reagents. In some embodiments, the three segments may be arranged continuously, while in other embodiments, these three segments may be separated by another segment or segments in between.

Figures 2A, 2B:
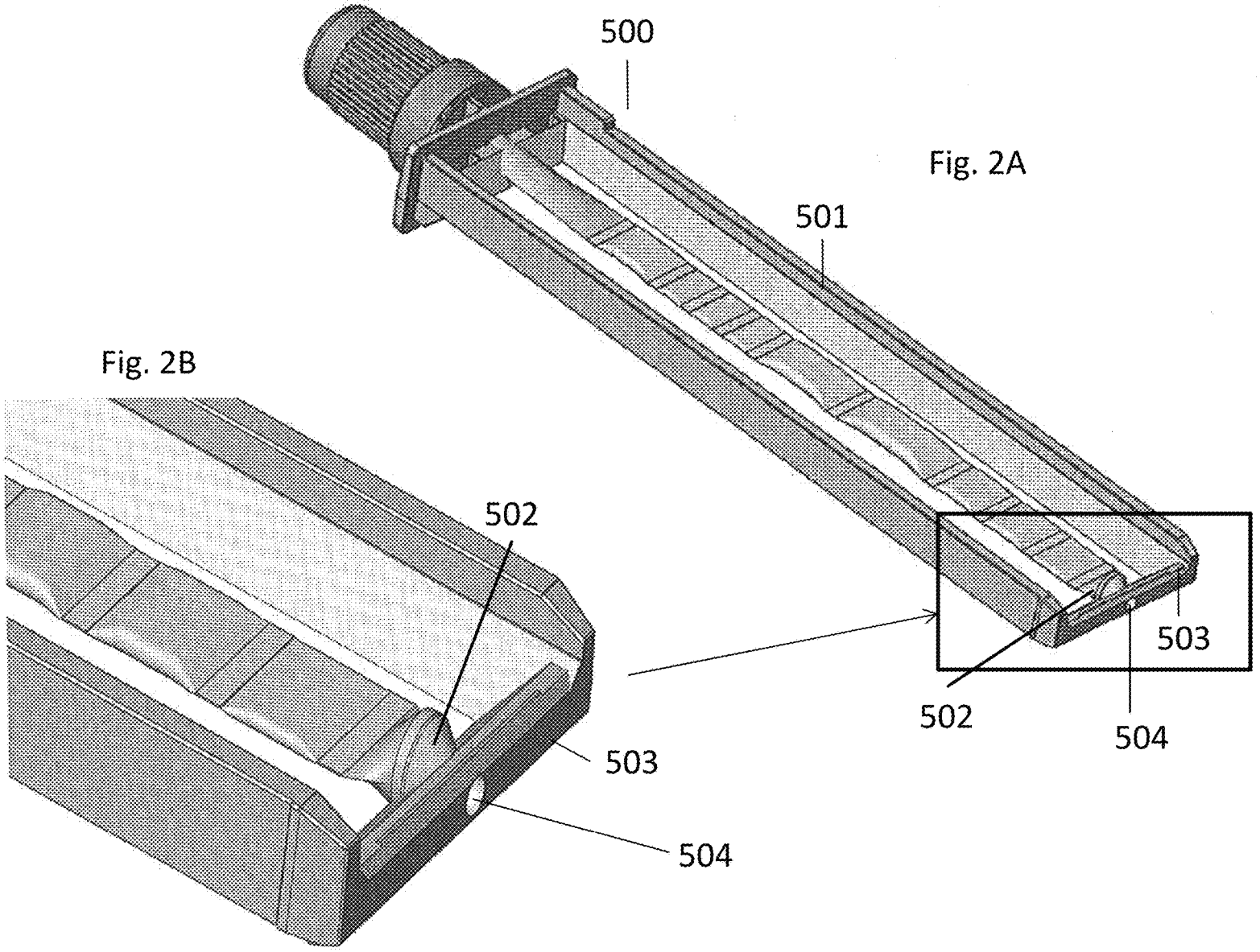
FIG. 2A is a cross sectional view of a sample tube including a tubule, a frame, and an extraction port.
FIG. 2B is an enlarged view of the extraction port.
Figure 2C:
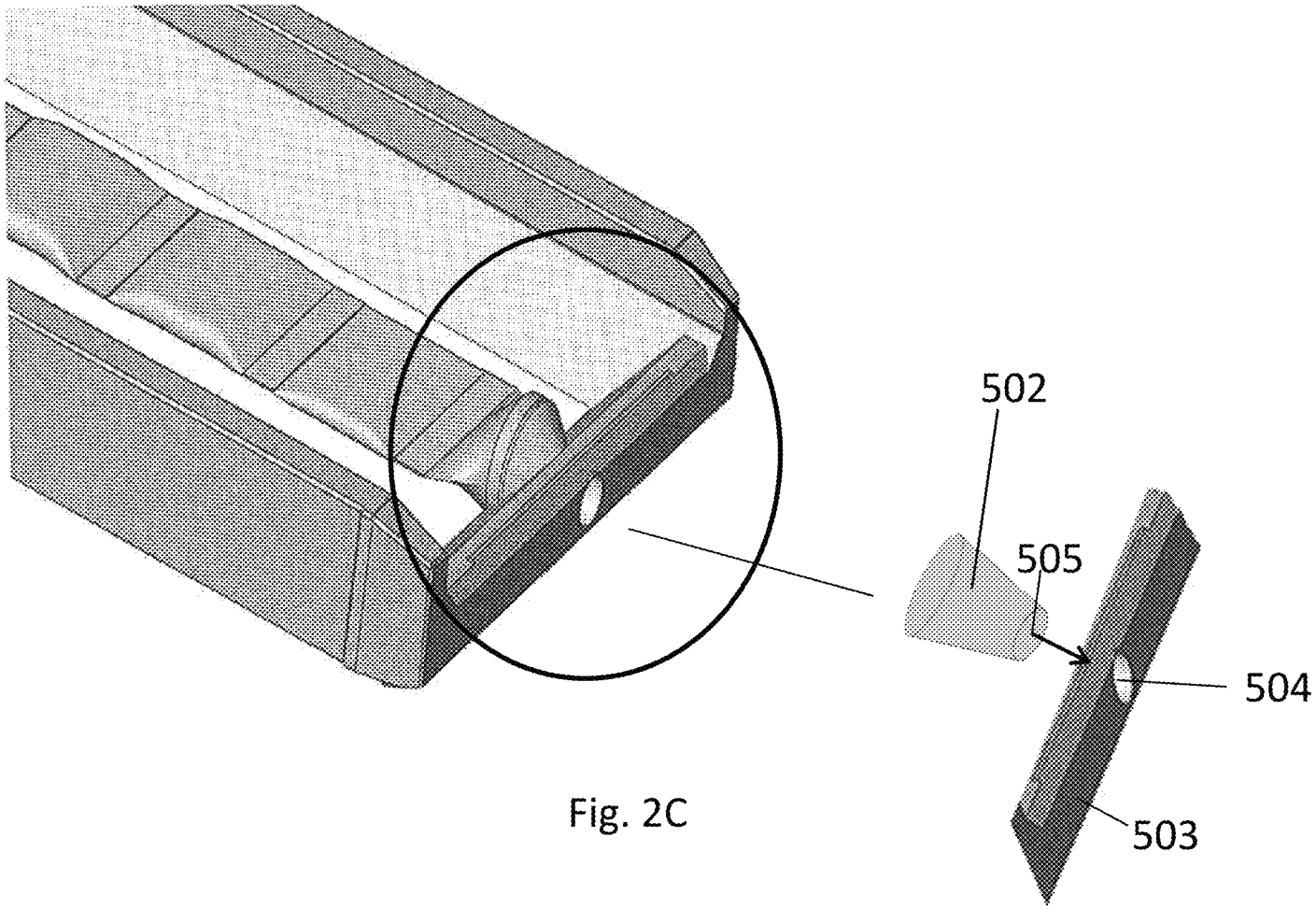
FIG. 2C is an enlarged view of the joint between the extraction port and the frame of the tubule.

In a particular embodiment, a pressure gate or a breakable seal 194 can be incorporated to selectively close and open an extraction port located at the distal end of the tubule, to collect the products generated during a test from the tubule for further processing outside of the tubule. The extraction port is shown in FIGS. 2A-2C. In some embodiments, a combination of a breakable seal and a pressure gate may be provided for transferring the contents of the tubule to the extraction port. In a specific embodiment, the extraction port is unidirectional and includes a check valve to prevent backward flow of liquid.

As shown in FIGS. 2A-2B, the tubule 500 comprises a frame 501 to which the tubule is mounted. In a particular embodiment, the extraction port 502 is fixedly mounted to a base 503 of the frame and the extraction port is accessed through an opening 504 in the base. An enlarged view of the extraction port is shown in FIG. 2B. The extraction port can be any suitable opening in a segment of the tubule from which an aliquot of the processed sample can be removed. For example, the extraction port can be a septum, a luer taper connection, a frangible seal, or a mechanical valve. If the extraction port is a septum, fluid can be removed from the port by piercing the septum with a needle or pipette tip and removing an aliquot of the processed sample. If the extraction port is a luer taper connection, a frangible seal, or a mechanical valve, the port is opened and an aliquot removed.

There are two varieties of luer taper connections: locking and slipping. Luer lock fittings are securely joined by means of a tabbed hub on the female fitting which screws into threads in a sleeve on the male fitting. Luer lock connectors include one-piece luer locks and two-piece luer locks or rotating collar luer locks. One-piece luer locks come as a single mold and locking is achieved by rotating the entire luer connector or system. In two-piece luer locks, a free rotating collar with threads is assembled to the luer and locking is achieved by rotating the collar. A frangible seal is one that is easily broken, torn, or cut, including but not limited to, a blister pack or a foil seal. In one embodiment, the frangible seal is resealable or self-sealing. Alternatively, the port can be a mechanical valve, including but not limited to, a stopcock, check valve, diaphragm valve, gate valve, globe valve, needle valve, pinch valve, piston valve, plug valve, etc.

In some embodiments a tube closing device for closing the tube after sample input may include a cap 20 (FIG. 1B) and/or clamp 310. An interface or adaptor 52 between the cap and the first opening of the flexible tubule may be used to ensure a secure, hermetic seal. In an exemplary embodiment, this interface may be threaded and may include tapered features 62 on the cap and/or a suitably rigid tube frame 50 such that, when fastened together, the threads 64 can engage to mate the tapered features 62 between the tube frame and cap to provide a suitable lock.

A substantially rigid frame 50 may be provided to hold the flexible tubule 10 suitably taut by constraining at least the proximal and distal ends of the tubule. In an exemplary embodiment, a first constraint may be provided to permanently attach and seal the tubule to the frame around the first opening of the tube. This seal may be created by welding the flexible tubule to the frame using thermal and/or ultrasonic sources. Alternatively, the seal may be created using a hot-melt adhesive joint with ethylene vinyl acetate, or by making a joint using a UV cure epoxy or other adhesives. In further embodiments, the tubule may be mechanically sealed or insert-molded with the frame.

A second constraint may be provided to attach and seal the tubule to the base of the frame via the extraction port. An exemplary embodiment of this second constraint is shown in FIG. 2C, wherein the extraction port is substantially open and/or capable of opening. The port enables access to the contents of the flexible tubule from the port and a portion 505 of the extraction port is joined to the base of the frame at the opening 504 by, e.g., welding using thermal and/or ultrasonic sources, hot-melt adhesive joined with ethylene vinyl acetate or by making a joint using a UV cure epoxy or other adhesive. Alternatively, a portion of the extraction port can be adhered to the base of the frame using a mechanical seal or insert-molded with the frame.

The tubule, extraction port, and frame materials can be optimized for joint manufacture. For example, the frame can be made of polypropylene having a lower melting point than the thinner tubule to ensure more uniform melting across one or more weld zones. To facilitate welding between the tubule and the frame, the joint area may be tapered or otherwise shaped to include energy directors or other commonly used features to enhance weld performance. In an exemplary embodiment, the rigid frame can be made of any suitable plastic by injection molding with its dimensions being approximately 150 mm tall by 25 mm wide.

In some embodiments, a method of extracting nucleic acids from biological samples by using the tubule described herein is contemplated. In certain embodiments, the sequence of events in such a test may include, e.g.: 1) biological sample collection with a collection tool, 2) placing the collected sample into a flexible tubule, which can include a plurality of segments that may contain the reagents required during the test, 3) capturing target organisms or nucleic acids present in the sample using at least one substrate positioned in the tubule that may be set at a controlled temperature and/or other suitable conditions for target capture during a set incubation period, 4) removal of organisms or molecules in the unprocessed sample by transferring liquid to a waste reservoir, 5) storing waste, in a waste reservoir, that can be segregated from the target by a clamp and/or actuator compressed against the tubule, 6) adding a wash buffer, released from another segment of the tubule, to remove reaction inhibitors, 7) adding an elution reagent, from another segment, that can release the target bound to the substrate after incubation at a controlled temperature, 8) detecting nucleic acids by techniques well known to those familiar in the art, including but not limited to, optionally adding adapter or tag sequences, amplifying target sequences, and/or hybridization-based target capture, and 9) collecting amplified nucleic acids through a second opening in the tubule for subsequent analysis. In exemplary embodiments the flow of the sample may be from the first opening towards the distal end of the tubule as the sample processing and/or test progresses while the flow of waste may be towards the closed sample input opening of the tubule, where a waste chamber in the cap of the tubule receives the waste for storage. Consequently, undesirable contact between a processed sample and surfaces in a reaction vessel that have been touched by the unprocessed sample is avoided, thereby preventing reaction inhibition due to trace amounts of reaction inhibitors present in the unprocessed sample and that might coat the walls of the reaction vessel.

While the foregoing description illustrates a nucleic acid amplification workflow performed in a sample processing tubule, the tubule can be configured to perform immunoassays, and it can also be adapted to prepare a sample and/or library for high throughput sequencing. The number, dimensions, and contents of the chambers in the tubule can be adjusted or modified based on the desired application without departing from the spirit or scope of the application.

As shown in FIG. 1A, some embodiments may incorporate the use of a test tube 1, with a flexible tubule 10 divided into a plurality of segments, such as segments 16, 110, 120, 130, 140, 150, 160, 170, 180, and/or 190, that may be transverse to the longitudinal axis of the tubule, and which may contain reagents, such as reagents 210, 221, 222, 230, 240, 250, 260, 270, 280, and/or 290; as well as an analyzer, that may have a plurality of actuators, such as actuators 312, 322, 332, 342, 352, 362, 372, 382, and/or 392, clamps, such as clamps 310, 320, 330, 340, 350, 360, 370, 380, and/or 390, and blocks, for example 314, 344, and/or 394 (others unnumbered for simplicity); opposing the actuators and clamps, to process a sample. Various combinations of these actuators, clamps, and/or blocks may be used to effectively clamp the tubule closed thereby segregating fluid. In exemplary embodiments, at least one of said actuators or blocks may have a thermal control element to control the temperature of a tubule segment for sample processing. The sample processing apparatus can further have at least one magnetic field source 430 capable of applying a magnetic field to a segment. The sample processing apparatus can further have a detection device 492, such as photometer or a CCD, to monitor a reaction taking place or completed within the tubule.

The combined use of the tube and the analyzer can enable many sample processing operations. Collecting a sample, such as blood, saliva, serum, soil, tissue biopsy, stool or other solid or liquid samples, can be accomplished by using a sample collection tool 30 that may be incorporated into the cap 20, or features 32 on the tube frame 50. After a suitable amount of the sample has been collected, the cap can be placed into the first opening of the tube to close the tube and deposit the sample into the first segment. Following this step, the sample contained on the collection tool may be washed off or re-suspended with reagents contained in separate chambers within the cap by compressing a portion of the cap. The tube can then be loaded into the analyzer for further processing. Identification features, such as a barcode or an RF tag, can be present on the tube to designate the sample's identity in a format that can be read by the analyzer and/or a user.

The present application is not to be limited in scope by the specific embodiments described herein. Indeed, various modifications in addition to those described herein will become apparent to those skilled in the art from the foregoing description and accompanying figures. Such modifications are intended to fall within the scope of the claims. Various publications are cited herein, the disclosures of which are incorporated by reference in their entireties.

The invention claimed is:

1. A sample processing tubule comprising, from a proximate to a distal end, an opening through which a sample is introducible, at least three segments, each of said segments being separated from adjacent segments via seals or pressure gates, a frame to which the tubule is mounted, and an extraction port fluidly connected to a distal segment of the at least three segments and fixedly attached to a base of said frame, said extraction port being accessed through an opening in said base and thereby enabling removal of a portion of a reaction mixture through said extraction port without opening a seal or a pressure gate between the distal segment and an adjacent segment of the tubule.

2. The sample processing tubule of claim 1, wherein said extraction port comprises a septum, a frangible seal, a luer taper connection, or a mechanical valve.

3. The sample processing tubule of claim 2, wherein said extraction port is a luer taper connection comprising a luer lock or luer slip.

4. The sample processing tubule of claim 2, wherein said extraction port comprises a septum that is pierceable by a needle or pipette tip.

5. A method of harvesting a reaction mixture from the distal segment of the sample processing tubule of claim 4, said method comprising piercing said septum with a needle or pipette tip and removing a portion of said reaction mixture through said port without piercing a seal between the distal segment and an adjacent segment of the tubule.

6. The method of claim 5, further comprising applying a vacuum to facilitate said step of removing a portion of said reaction mixture through said port.

7. The method of claim 5, wherein said method is performed within an instrument adapted to receive said tubule and perform one or more sample processing steps on one or more segments of said tubule.

8. The method of claim 5, wherein said method further comprises removing said tubule from an instrument adapted to receive said tubule and manually performing said step of removing a portion of said reaction mixture through said port.

9. A method of harvesting a reaction mixture from the distal segment of the sample processing tubule of claim 2, wherein said extraction port is a frangible seal, luer taper connection or a mechanical valve, and said method comprises opening said extraction port and removing a portion of said reaction mixture through said port without piercing a seal between the distal segment and an adjacent segment of the tubule.

10. A method of processing a sample in a tubule of claim 1, comprising:

introducing a fluid through said opening, driving fluid flow from a first segment at the proximate end of said tubule to said distal segment, thereby contacting said sample with one or more reagents positioned in said tubule and/or reaction conditions to transform at least a portion of said sample into a reaction mixture, and removing an aliquot of said reaction mixture from said extraction port without piercing a seal between the distal segment and an adjacent segment of the tubule.

* * * * *